US005314798A

United States Patent [19]

Brust et al.

[11] Patent Number: 5,314,798

[45] Date of Patent: May 24, 1994

[54] IODIDE BANDED TABULAR GRAIN EMULSION

[75] Inventors: Thomas B. Brust, Spencerport; Mark R. Mis, North Tonawanda, both of N.Y.

[73] Assignee: Eastman Kodak Company, Rochester, N.Y.

[21] Appl. No.: 48,434

[22] Filed: Apr. 16, 1993

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS 4,439,520 3/1984 Kofron et al. ..... 430/434

FOREIGN PATENT DOCUMENTS

0534395A1 3/1993 European Pat. Off. .

*Primary Examiner*—Janet C. Baxter

*Attorney, Agent, or Firm*—Carl O. Thomas

[57] ABSTRACT

A radiation sensitive emulsion is disclosed containing a high chloride {100} tabular grain population in which the tabular grains contain bands of higher iodide.

11 Claims, No Drawings

IODIDE BANDED TABULAR GRAIN EMULSION

FIELD OF THE INVENTION

The invention relates to radiation sensitive photographic emulsions.

RELATED PATENT APPLICATIONS

Maskasky U.S. Ser. No. 08/035,349, filed Mar. 22, 1993, as a continuation in-part of U.S. Ser. No. 955,010, filed Oct. 1, 1992, which is in turn a continuation-in-part of U.S. Ser. No. 764,868, filed Sep. 24, 1991, titled HIGH TABULARITY HIGH CHLORIDE EMULSIONS WITH INHERENTLY STABLE GRAIN FACES, commonly assigned, discloses high aspect ratio tabular grain high chloride emulsions containing tabular grains that are internally free of iodide and that have {100} major faces. In a preferred form, Maskasky employs an organic compound containing a nitrogen atom with a resonance stabilized $\pi$ electron pair to favor formation of {100} faces.

House, Brust, Hartsell and Black U.S. Ser. No. 08/034,060, filed Mar. 22, 1993, as a continuation-in-part of U.S. Serial No. 940,404, filed Sep. 3, 1992, which is in turn a continuation-in-part of U.S. Ser. No. 826,338, filed Jan. 27, 1992, each commonly assigned, titled HIGH ASPECT RATIO TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 $\mu$m and having higher aspect ratios than any remaining tabular grains satisfying these criteria (1) have an average aspect ratio of greater than 8 and (2) internally at their nucleation site contain iodide and at least 50 mole percent chloride.

Brust, House, Hartsell and Black U.S. Ser. No. 08/035,009, filed Mar. 22, 1993, and commonly assigned, titled MODERATE ASPECT RATIO TABULAR GRAIN EMULSIONS AND PROCESSES FOR THEIR PREPARATION, discloses radiation sensitive emulsions comprised of a dispersing medium and silver halide grains. At least 50 percent of total grain projected area is accounted for by tabular grains bounded by {100} major faces having adjacent edge ratios of less than 10, each having an aspect ratio of at least 2 and an average aspect ratio of up to 8, and internally at their nucleation site containing iodide and at least 50 mole percent chloride. A process of preparing the emulsions is also disclosed.

House, Brust, Hartsell, Black, Antoniades, Tsaur and Chang U.S. Ser. No. 08/033,739, filed Mar. 22, 1993, as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled PROCESSES OF PREPARING TABULAR GRAIN EMULSIONS, discloses processes of preparing emulsions containing tabular grains bounded by {100} major faces of which tabular grains bounded by {100} major faces account for 50 percent of total grain projected area selected on the criteria of adjacent major face edge ratios of less than 10 and thicknesses of less than 0.3 $\mu$m and internally at their nucleation site contain iodide and at least 50 mole percent chloride, comprised of the steps of (1) introducing silver and halide salts into the dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth under conditions that maintain the {100} major faces of the tabular grains until the tabular grains exhibit an average aspect ratio of greater than 8.

Puckett U.S. Ser. No. 08/033,738, filed Mar. 22, 1993, and commonly assigned, titled OLIGOMER MODIFIED TABULAR GRAIN EMULSIONS discloses radiation sensitive emulsions and processes for their preparation. At least 50 percent of total grain projected area is accounted for by high chloride tabular grains bounded by {100} major faces having adjacent edge ratios of less than 10, each having an aspect ratio of at least 2, containing on average at least one pair of metal ions chosen from group VIII, periods 5 and 6, at adjacent cation sites in their crystal lattice, and internally at their nucleation site containing iodide and at least 50 mole percent chloride.

Brust, House, Hartsell, Black, Maretti and Budz U.S. Ser. No. 08/034,982, filed Mar. 22, 1993, as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled COORDINATION COMPLEX LIGAND MODIFIED TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 $\mu$m and having higher aspect ratios than any remaining tabular grains satisfying these criteria (1) have an average aspect ratio of greater than 8 and (2) internally at their nucleation site contain iodide and at least 50 mole percent chloride. The tabular grain contain non-halide coordination complex ligands.

Budz, Ligtenberg and Roberts U.S. Ser. No. 08/034,050, filed Mar. 22, 1993, and commonly assigned, titled DIGITAL IMAGING WITH TABULAR GRAIN EMULSIONS, discloses digitally imaging photographic elements containing tabular grain emulsions comprised of a dispersing medium and silver halide grains containing at least 50 mole percent chloride, based on silver. At least 50 percent of total grain projected area is accounted for by tabular grains bounded by {100} major faces having adjacent edge ratios of less than 10, each having an aspect ratio of at least 2.

Szajewski U.S. Ser. No. 08/034,061, filed Mar. 22, 1993, and commonly assigned, titled FILM AND CAMERA, discloses roll films and roll film containing cameras containing at least one emulsion layer is present containing tabular grain emulsions comprised of a dispersing medium and silver halide grains containing at least 50 mole percent chloride, based on silver. At least 50 percent of total grain projected area is accounted for by tabular grains bounded by {100} major faces having adjacent edge ratios of less than 10, each having an aspect ratio of at least 2.

Lok and Budz U.S. Ser. No. 08/034,317, filed Mar. 22, 1993, and commonly assigned, titled TABULAR GRAIN EMULSIONS CONTAINING ANTIFOGGANTS AND STABILIZERS discloses tabular grain emulsions comprised of a dispersing medium, silver halide grains containing at least 50 mole percent chloride, based on silver, and at least one selected antifoggant or stabilizer. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Maskasky U.S. Ser. No. 08/034,998, filed Mar. 22, 1993, and commonly assigned, titled MODERATE ASPECT RATIO TABULAR GRAIN HIGH CHLORIDE EMULSIONS WITH INHERENTLY STABLE GRAIN FACES, discloses an emulsion containing a grain population internally free of iodide at the grain nucleation site and comprised of at least 50 mole percent chloride. At least 50 percent of the grain population projected area is accounted for by {100} tabular grains each having an aspect ratio of at least 2 and together having an average aspect ratio of up to 7.5.

Szajewski and Buchanan U.S. Ser. No. 08/035,347, filed Mar. 22, 1993, and commonly assigned, titled METHOD OF PROCESSING PHOTOGRAPHIC ELEMENTS CONTAINING TABULAR GRAIN EMULSIONS, discloses a process of developing and desilvering a dye image forming photographic element containing a high chloride {100} tabular grain emulsion of the type herein disclosed.

BACKGROUND

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be achieved by employing tabular grain emulsions. These advantages are demonstrated in Kofron et al U.S. Pat. No. 4,439,520.

An emulsion is generally understood to be a "tabular grain emulsion" when tabular grains account for at least 50 percent of total grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain.

High chloride tabular grain emulsions are disclosed by Kofron et al. The term "high chloride" refers to grains that contain at least 50 mole percent chloride based on silver. In referring to grains of mixed halide content, the halides are named in order of increasing molar concentrations—e.g., silver iodochloride contains a higher molar concentration of chloride than iodide.

The overwhelming majority of tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering high chloride tabular grains. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

Brust et al EPO 534,395, published Mar. 31, 1993, discloses radiation sensitive high chloride {100} tabular grain emulsions. As employed herein the term "high chloride {100} tabular grain emulsion" indicates a high chloride tabular grain emulsion in which the tabular grains accounting for at least 50 percent of total grain projected area have major faces lying in {100} crystallographic planes. The high chloride {100} tabular grain emulsions of Brust et al represent an advance in the art in that (1) by reason of their tabular shape, they achieve the known advantages of tabular grain emulsions over nontabular grain emulsions, (2) by reason of their high chloride content they achieve the known advantages of high chloride emulsions over those of other halide compositions (e.g., low blue native sensitivity, rapid development, and increased ecological compatibility—that is, rapid processing with more dilute developer solutions and rapid fixing with ecologically preferred sulfite ion fixers), and (3) by reason of their {100} crystal faces the tabular grains exhibit higher levels of grain shape stability, allowing the use of morphological stabilizers adsorbed to grain surfaces during emulsion preparation to be entirely eliminated. A further and surprising advantage of Brust et al is that the high chloride {100} tabular grain emulsion sensitivity levels can be higher than previously thought possible for high chloride emulsions.

Historically photographic applications requiring higher photographic speeds have been served by employing photographic elements containing silver iodobromide emulsions, since these emulsions can exhibit the most favorable speed-granularity relationships. With the improved speed-granularity relationships obtained using the high chloride {100} tabular grain emulsions of Brust et al, the realization has occurred that high chloride {100} tabular grain emulsions can be used for photographic applications, such as films for use in hand held cameras, that have traditionally been served by silver bromoiodide emulsions, allowing the advantages of the high chloride composition to be obtained in these applications. However, Brust et al, though improving the speed-granularity position of high chloride emulsions, still has not equalled the best speed-granularity relationships of silver iodobromide emulsions.

SUMMARY OF THE INVENTION

The present invention has as its purpose to provide a high chloride {100} tabular grain emulsion that in addition to providing the advantages of the Brust et al emulsions also provides speed-granularity relationships that are superior to those of Brust et al.

In one aspect this invention is directed to a radiation sensitive emulsion containing a silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions.

DESCRIPTION OF THE PREFERRED EMBODIMENTS

The photographically useful, radiation sensitive emulsions of the invention are comprised of a dispersing medium and a high chloride silver halide grain population. At least 50 percent of total grain projected area of the high chloride grain population is accounted for by tabular grains which (1) are bounded by {100} major faces having adjacent edge ratios of less than 10 and (2) each have an aspect ratio of at least 2.

The reason for requiring adjacent edge ratios of less than 10 for the major faces of the tabular grains is to provide a definite boundary for excluding from the tabular grain population those grains that are highly elongated. Such grains are commonly referred to as rods. In the preferred form of the invention the grains included in the tabular grain population are those in which the {100} major face adjacent edge ratios are less than 5 and, optimally, less than 2. It is believed that the grains with lower ratios of adjacent edge lengths are less susceptible to pressure induced alterations of sensitivity.

Since each tabular grain must exhibit an aspect ratio (ECD/t) of at least 2, the average aspect ratio of the high chloride {100} tabular grain population can only approach 2 as a lower limit. In fact, the tabular grain emulsions of the invention typically exhibit average aspect ratios of 3 or more, with high average aspect ratios (>8) being preferred. That is, preferred emulsions according to the invention are high aspect ratio tabular grain emulsions. In specifically preferred emulsions according to the invention average aspect ratios of the tabular grain population are at least 12 and optimally at least 20. Typically the average aspect ratio of the tabular grain population ranges up to 50, but higher aspect ratios of 100, 200 or more can be realized. Emulsions within the contemplation of the invention in which the average aspect ratio approaches the minimum average aspect ratio limit of 2 still provide a surface to volume ratio that is substantially higher than that of cubic grains.

The tabular grain population can exhibit any grain thickness that is compatible with the average aspect ratios noted above. However, it is preferred to limit additionally the grains included in the selected tabular grain population to those that exhibit a thickness of less than 0.35 μm and, optimally, less than 0.2 μm. It is appreciated that the aspect ratio of a tabular grain can be limited either by limiting its equivalent circular diameter or increasing its thickness. Thus, when the average aspect ratio of the tabular grain population is in the range of from >2 to 8, the tabular grains accounting for at least 50 percent of total grain projected area can also each exhibit a grain thickness of less than 0.3 μm or less than 0.2 μm. Nevertheless, in the aspect ratio range of from >2 to 8 particularly, there are specific photographic applications that can benefit by greater tabular grain thicknesses. For example, in constructing a blue recording emulsion layer of maximum achievable speed it is specifically contemplated that tabular grain thicknesses that are on average 1 μm or or even larger can be tolerated. This is because the eye is least sensitive to the blue record and hence higher levels of image granularity (noise) can be tolerated without objection. There is an additional incentive for employing larger grains in the blue record in that it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient. The blue light deficiency of many artificial illuminants, such as tungsten filament lamps, also places a higher speed requirement on the blue recording emulsion layers.

Another advantageous application for thicker tabular grains occurs in underlying emulsion layers of multilayer photographic elements, particularly in the layer or layers nearest the support. In such layer arrangements it has been observed that lower frequency (<20 cycles/mm) modulation transfer factor (MTF) measurements confirm improved image definition to result from increasing the thickness of the tabular grains. When the blue recording layer unit of a multicolor photographic element is coated nearest the support or underlying at least one other of the emulsion layer units, it is appreciated that the thicker tabular grains can conform to the thickness ranges noted for blue recording tabular grains noted above and also provide improved image sharpness.

In one specifically preferred form of the invention the tabular grain population accounting for at least 50 percent of total grain projected area is provided by tabular grains also exhibiting thicknesses of less than 0.2 μm. In other words, the emulsions are in this instance thin tabular grain emulsions.

Ultrathin tabular grain emulsions have been prepared satisfying the requirements of the invention. Ultrathin tabular grain emulsions are those in which the selected tabular grain population is made up of tabular grains having an average thickness of less than 0.06 μm. Prior to the Brust et al invention the only ultrathin tabular grain emulsions (other than silver iodide tabular grain emulsions) contained tabular grains bounded by {111} major faces. In other words, it was thought essential to form tabular grains by the mechanism of parallel twin plane incorporation to achieve ultrathin dimensions. Emulsions according to the invention can be prepared in which the tabular grain population has a mean thickness down to 0.02 μm and even 0.01 μm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions according to the invention can have entirely negligible levels of blue sensitivity, and are therefore capable of providing a green or red record in a photographic product that exhibits minimal blue contamination even when located to receive blue light. Additionally, the ultrathin tabular grain emulsions exhibit reduced levels of ultraviolet (UV) sensitivity. This permits reduction of or elimination of UV absorbers. To a significant, but lesser degree reduced blue and UV sensitivity is also exhibited by thin tabular grains.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (μm); and t is grain thickness in μm.

The high chloride tabular grain population accounting for 50 percent of total grain projected area preferably exhibits a tabularity of greater than 25 and most preferably greater than 100. Since the tabular grain population can be ultrathin, it is apparent that extremely high tabularities, ranging to 1000 and above are within the contemplation of the invention.

The tabular grain population can exhibit an average ECD of any photographically useful magnitude. For photographic utility average ECD's of less than 10 μm are contemplated, although average ECD's in most photographic applications rarely exceed 6 μm. Within ultrathin tabular grain emulsions satisfying the requirements of the invention it is possible to provide intermediate (5 to 8) average aspect ratios with ECD's of the tabular grain population of 0.10 μm and less. As is generally understood by those skilled in the art, emulsions with selected tabular grain populations having higher ECD's are advantageous for achieving relatively high levels of photographic sensitivity. For such applications it preferred that the tabular grains exhibit average ECD's of at least 0.5 μm. Selected tabular grain populations with lower ECD's are advantageous in achieving low levels of granularity.

So long as the population of tabular grains satisfying the parameters noted above accounts for at least 50 percent of total grain projected area a photographically desirable grain population is available. It is recognized that the advantageous properties of the emulsions of the invention are increased as the proportion of tabular grains having {100} major faces is increased. The preferred emulsions according to the invention are those in which at least 70 percent and optimally at least 90 percent of total grain projected area is accounted for by tabular grains having {100} major faces.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain descriptions above are specifically contemplated.

A feature that distinguishes the high chloride {100} tabular grains of the emulsions of this invention from the emulsions of Brust et al is the presence of a band exhibiting a higher level of iodide ions. The higher iodide band is introduced into the grains during precipitation, but after grain nucleation and is preferably delayed well into the growth stage of precipitation. Hence the higher iodide band surrounds a core portion of the tabular grain formed during the earlier stages of precipitation.

It is preferred to delay introduction of the iodide band into the tabular grains until a grain core has been formed that accounts for at least 5 percent of the total silver forming the tabular grains. It is specifically preferred that the core account for at least 25 percent of total silver and optimally at least 50 percent of total silver.

It is specifically contemplated to defer formation of the higher iodide band until the end of the precipitation procedure, so that the band either forms or lies adjacent the exterior portion of the tabular grains. When the higher iodide band is formed before the completion of precipitation, the band necessarily is located within the tabular grain structure. That is, the band is itself surrounded by a shell. Although the description is generally confined to tabular grain structures containing a single higher iodide band, with or without a surrounding shell, it is recognized that there is no reason in principle why the tabular grains could not be provided with multiple bands separated by intermediate shells.

As demonstrated in the Examples below the advantage of the higher iodide band does not lie in the mere elevation of the iodide level, but in the nonuniformity of the iodide distribution within the grain structure. The nonuniformity of the iodide distribution is controlled both by the level of iodide introduced in forming the band and by restricting the proportion of the total grain structure formed by the band.

In the preferred form of the invention the higher iodide band accounts for up to 5 percent of the silver forming the high chloride {100} tabular grain structure. Optimally the higher iodide band accounts for up to 2 percent of the silver forming the grain structure. However, the higher iodide band can account for a higher proportion (e.g., up 30 percent) of the silver forming the high chloride {100} tabular grain structure.

The minimum proportion of the grain structure accounted for by the band is a function of the iodide content to be added to the tabular grain structure by the presence of the band. In the preferred form of the invention the higher iodide band adds sufficient iodide to increase the average iodide content of the high chloride {100} tabular grain structure by at least 0.1 mole percent and, optimally at least 0.2 mole percent. The maximum silver content of the band, noted above, sets a maximum theoretical upper limit on iodide incorporation by the band. In practice if sufficient iodide is added during precipitation to increase average tabular grain iodide content to a value of 5 mole percent higher than that of the core, there is generally some evidence of grain renucleation. That is, a separate population of grains containing a higher iodide level is formed. So long as the tabular grain projected area requirements discussed above are preserved renucleation can be tolerated. However, it is generally preferred to form the higher iodide band while minimizing or eliminating renucleation. For this reason it is specifically preferred to limit the iodide content of the band to that which increases the average iodide content of the high chloride {100} tabular grains to up to 2 mole percent above the average iodide content of the grain core.

While it is demonstrated in the examples below that the higher iodide bands dramatically improve the speed-granularity relationships of the emulsions of the invention as compared to high chloride {100} tabular grain emulsions having uniform iodide distributions, the mechanism by which the speed-granularity relationship has been improved is not known with any certainty. It can be stated with confidence that the iodide ions incorporated into the cubic crystal lattice (not to be confused with cubic crystal faces) provided by the silver chloride is at least strained by the presence of iodide ions, since the iodide ions are much larger than the chloride ions they replace in the crystal structure. It is known that high iodide silver halide (>90 mole percent I) does not form a cubic crystal lattice under the conditions of photographic emulsion precipitation. Hence, there is a possibility, not corroborated that at least a portion of the iodide ions in the band may form a separate epitaxial phase. There is indirect evidence of crystal lattice imperfections by the demonstrations of lowered photoconductivity in the Examples. This suggests that conductance band electrons photogenerated by imagewise exposure may be collected at crystal defect sites created by the higher iodide bands, thereby increasing the photoefficiency of the grains and, as a consequence, improving their speed-granularity relationship.

While there is no intention to be bound by any particular theory to account for the structure or effectiveness of the emulsions of the invention, these theories have led to certain preferences. During band formation it is preferred to introduce the iodide ions into the grains in a manner that enhances the opportunity for crystal lattice imperfections or strains. Thus, the iodide introduced during band formation is preferably abruptly introduced at the maximum achievable introduction rate. This is commonly referred to as an iodide dump. The iodide is preferably introduced as a soluble salt (e.g., alkali, alkaline earth or ammonium iodide) without the concurrent introduction of silver ion salts. With this approach the iodide ions displace chloride ions in the crystal lattice at the core surface. Alternatively, silver ions can be concurrently introduced, as by concurrently introducing silver nitrate through a silver jet. The presence of significant concentrations of both silver and iodide ions in solution, however, increases the risk of renucleation forming a separate higher iodide phase or grain population. It is specifically contemplated to form the higher iodide band by the double-jet addition of silver ions and iodide ions or a combination of iodide and other halide ions. The introduction of a high iodide Lippmann emulsion during band formation is an art recognized alternative to the double-jet addition of silver and halide ions, and this approach is contemplated, but not preferred.

It has been observed that the speed-granularity relationships of the iodide banded high chloride {100} tabular grain emulsions can be further enhanced by the presence of ripening agents during band precipitation. The ripening agents and their concentrations can take any form described below as appropriate for grain growth.

Apart from the adjustments during band formation noted above, the high chloride {100} tabular grain emulsions of this invention can be prepared by the procedures taught by Brust et al, cited above. In that process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion. The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more growth accelerating irregularities in one or more of the cubic crystal faces. The cubic crystal faces that contain at least one such irregularity thereafter accept silver halide at an accelerated rate as compared to the regular cubic crystal faces (i.e., those lacking a screw dislocation). When only one of the cubic crystal faces contains the irregularity, grain growth on only one face is accelerated, and the resulting grain structure on continued growth is a rod. The same result occurs when only two opposite parallel faces of the cubic crystal structure contain growth accelerating irregularities. However, when any two contiguous cubic crystal faces contain the irregularity, continued growth accelerates growth on both faces and produces a tabular grain structure. It is believed that the tabular grains of the emulsions of this invention are produced by those grain nuclei having two, three or four faces containing growth accelerating dislocations. Although it was initially believed that the growth accelerating dislocations were screw dislocations, further investigation has not confirmed this hypothesis.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In the preferred form of the invention silver iodochloride grain nuclei are formed during the nucleation step. Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to above as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. It is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation. To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described above.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of emulsions according to the invention it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth to obtain the emulsions of the invention can proceed according to any convenient conventional precipitation technique for the precipitation of silver halide grains bounded by {100} grain faces, interrupted only by band formation as described above. Chloride ions are required to be incorporated into the grains during nucleation and are therefore present in the completed grains at the internal nucleation site. In addition chloride ions are required to be introduced during grain growth in order to satisfy the high (at least 50 mole percent) chloride requirements of the tabular grains. Iodide ions must be introduced during at least the precipitation of the band region of the grains. Hence, in their simplest form the grains are silver iodochloride grains. It is preferred that iodide ions be introduced during nucleation as well as during band formation. Bromide ions can be present during precipitation, allowing silver iodobromochloride and silver bromoiodochloride grains to be formed. Iodide in addition to that employed during nucleation and band formation can be introduced during grain growth; however, iodide ion concentrations in the portions of the grain other than the band cannot exceed those in the band region of the grain. When chloride ions are being introduced, pCl is maintained within the ranges described above for nucleation. If bromide ions are introduced without also introducing chloride ions, pBr is maintained in the range of from 1.0 to 4.2 and preferably 1.6 to 3.4.

It has been observed that up to 20 percent reductions in tabular grain thicknesses can be realized by specific halide introductions during grain growth. It has been observed that bromide ion additions during the growth step in the range of from 0.05 to 15 mole percent, preferably from 1 to 10 mole percent, based on silver, produce relatively thinner {100} tabular grains than can be realized under the same conditions of precipitation in the absence of bromide ion. Similarly, it has been observed that iodide additions during the growth step in the range of from 0.001 to $<1$ mole percent produce relatively thinner {100} tabular grains than can be realized under the same conditions of precipitation in the absence of iodide ion. From this observation it is apparent that in their preferred form the iodide content of the high chloride {100} tabular grains outside of the band region preferably exhibit an iodide concentration of less than 1 mole percent.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et at European Patent Application 80102242, and Wey "Growth Mechanism of AgBr Crystals in Gelatin Solution", *Photographic Science and Engineering*, Vol. 21, No. 1, Jan./Feb. 1977, p. 14, et seq.

In the simplest form of the invention the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described above. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). This is commonly referred to as dual-zone precipitation. In dual-zone precipitation arrangement an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990). It is preferred to introduce silver and halide ions to the growth reaction vessel through the nucleation reaction vessel not only during only the early stages of precipitation, but also during the growth stage of precipitation. The small grains that are introduced into the growth reaction vessel once the growth stage is underway are, of course, ripened out. That is, the small silver halide grains introduced from the nucleation reaction vessel during the growth stage simply serve as a source of silver and halide ions for growth of the previously formed grain population.

Although the process of grain nucleation has been described above in terms of utilizing iodide to produce the crystal irregularities required for tabular grain formation, alternative nucleation procedures have been devised, demonstrated in the Examples of Brust et al, that eliminate any requirement of iodide ion being present during nucleation in order to produce tabular grains.

It has been observed that rapid grain nucleations, including so-called dump nucleations, in which significant levels of dispersing medium supersaturation with halide and silver ions exist at nucleation accelerate introduction of the grain irregularities responsible for tabularity. Since nucleation can be achieved essentially instantaneously, immediate departures from initial supersaturation to the preferred pCl ranges noted above are entirely consistent with this approach.

It has also been observed that maintaining the level of peptizer in the dispersing medium during grain nucleation at a level of less than 5 percent by weight enhances of tabular grain formation. It is believed that coalescence of grain nuclei pairs can be at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. Further moderated levels of grain adsorption can be achieved with so-called "synthetic peptizers"—that is, peptizers formed from synthetic polymers. The maximum quantity of peptizer compatible with limited coalescence of grain nuclei is, of course, related to the strength of adsorption to the grain surfaces. Once grain nucleation has been completed, immediately after silver salt introduction, peptizer levels can be increased to any convenient conventional level for the remainder of the precipitation process.

The emulsions of the invention include silver chloride, silver iodochloride emulsions, silver iodo-bromochloride emulsions and silver iodochlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium , rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, Nov./Dec. 1980, pp. 265-257, and Grzeskowiak et al published European Patent Application 0 264 288.

The invention is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to nontabular forms. Particularly preferred high chloride emulsions are according to the invention that are those that contain more than 70 mole percent (optimally more than 90 mole percent) chloride.

Although not essential to the practice of the invention, a further procedure that can be employed to maximize the population of tabular grains having {100} major faces is to incorporate an agent capable of restraining the emergence of non-{100}grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized $\pi$ electron pair. Resonance stabilization prevents protonation of the nitrogen atom under the relatively acid conditions of precipitation.

Aromatic resonance can be relied upon for stabilization of the x electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

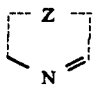

(I)

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

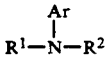

(II)

where

Ar is an aromatic ring structure containing from to 14 carbon atoms and $R^1$ and $R^2$ are independently hydrogen, Ar, or any convenient aliphatic group or together complete a five or six membered ring. Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae I and/or II:

RA-1

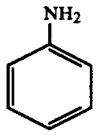

aniline

RA-2

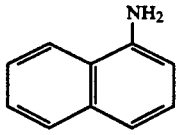

α-naphthylamine

RA-3

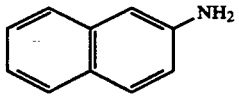

β-naphthylamine

RA-4

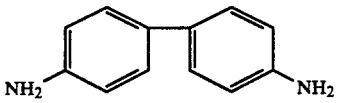

benzidine

RA-5

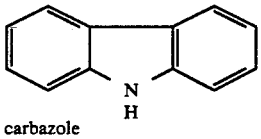

carbazole

RA-6

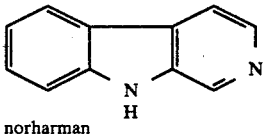

norharman

RA-7

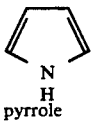

pyrrole

RA-8

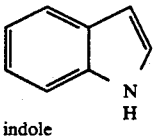

indole

RA-9

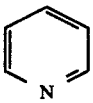

pyridine

RA-10

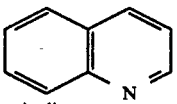

quinoline

RA-11

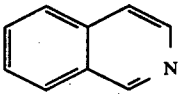

isoquinoline

-continued

RA-12

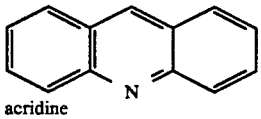

acridine

RA-13

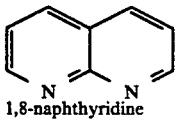

1,8-naphthyridine

RA-14

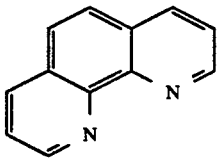

1,10-phenanthroline

RA-15

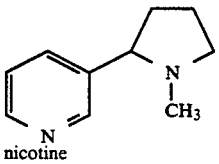

nicotine

RA-16

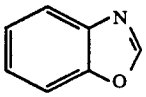

benzoxazole

RA-17

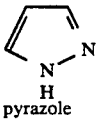

pyrazole

RA-18

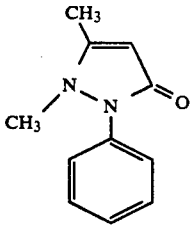

antipyrine

RA-19

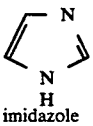

imidazole

RA-20

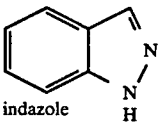

indazole

RA-21

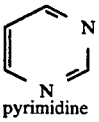

pyrimidine

-continued

RA-22

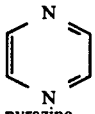

pyrazine

RA-23

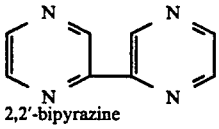

2,2'-bipyrazine

RA-24

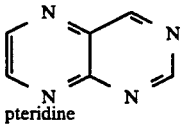

pteridine

RA-25

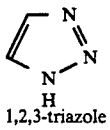

1,2,3-triazole

RA-26

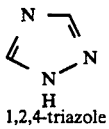

1,2,4-triazole

RA-27

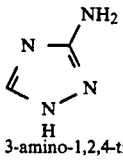

3-amino-1,2,4-triazole

RA-28

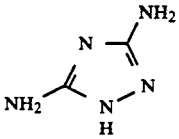

3,5-diamino-1,2,4-triazole

RA-29

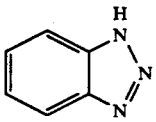

benzotriazole

RA-30

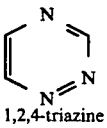

1,2,4-triazine

RA-31

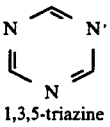

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. .In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by Br⁻Ions", Parts I and II, *Journal of Colloid and Interface Science,* Vol. 140, No. 2, Dec. 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

The emulsions of the invention can be chemically sensitized with active gelatin as illustrated by T. H. James, *The Theory of the Photographic Process,* 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure, Vol.* 120, April, 1974, Item 12008, *Research Disclosure,* Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 97,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure,* Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure,* Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions of the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering,* Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions of the invention are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions,* American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1
Anhydro-5'-chloro-3'-di-(3-sulfopropyl)naphtho[1,2-d]thiazolothiacyanine hydroxide, sodium salt SS-2
Anhydro-5'-chloro-3'-di-(3-sulfopropyl)naphtho[1,2-d]oxozolothiacyanine hydroxide, sodium salt SS-3
Anhydro-4,5-benzo-3'-methyl-4'-phenyl-1-(3-sulfopropyl)naphtho[1,2-d]thiazolothiazolocyanine hydroxide SS-4
1,1'-Diethylnaphtho[1,2-d]thiazolo-2'-cyanine bromide SS-5
Anhydro-1,1'-dimethyl-5,5'-di-(trifluoromethyl)-3-(4-sulfobuyl)-3'-(2,2,2-trifluoroethyl)benzimidazolocarbocyanine hydroxide SS-6
Anhydro-3,3'-(2-methoxyethyl)-5,5'-diphenyl-9-ethyloxacarbocyanine, sodium salt SS-7
Anhydro-11-ethyl-1,1'-di-(3-sulfopropyl)naphtho[1,2-d]oxazolocarbocyanine hydroxide, sodium salt SS-8
Anhydro-5,5'-dichloro-9-ethyl-3,3'-di-(3-sulfopropyl-)oxaselenacarbocyanine hydroxide, sodium salt SS-9
5,6-Dichloro-3',3'-dimethyl-1,1',3-triethylbenzimidazolo-3H-indolocarbocyanine bromide
SS-10
Anhydro-5,6-dichloro-1,1-diethyl-3-(3-sulfopropylbenzimidazolooxacarbocyanine hydroxide
SS-11
Anhydro-5,5'-dichloro-9-ethyl-3,3'-di-(2-sulfoethylcarbamoylmethyl)thiacarbocyanine hydroxide, sodium salt
SS-12
Anhydro-5',6'-dimethoxy-9-ethyl-5-phenyl-3-(3-sulfobutyl)-3'-(3-sulfopropyl)oxathiacarbocyanine hydroxide, sodium salt
SS-13
Anhydro-5,5'-dichloro-9-ethyl-3-(3-phosphonopropyl)-3'-(3-sulfopropyl)thiacarbocyanine hydroxide
SS-14
Anhydro-3,3'-di-(2-carboxyethyl)-5,5'-dichloro-9-ethylthiacarbocyanine bromide
SS-15
Anhydro-5,5'-dichloro-3-(2-carboxyethyl)-3'-(3-sulfopropyl)thiacyanine sodium salt
SS-16
9-(5-Barbituric acid)-3,5-dimethyl-3'-ethyltellurathiacarbocyanine bromide
SS-17
Anhydro-5,6-methylenedioxy-9-ethyl-3-methyl-3'-(3-sulfopropyl)tellurathiacarbocyanine hydroxide
SS-18
3-Ethyl-6,6'-dimethyl-3'-pentyl-9.11-neopentylenethiadicarbocyanine bromide
SS-19
Anhydro-3-ethyl-9,11-neopentylene-3'-(3-sulfopropyl)-thiadicarbocyanine hydroxide
SS-20
Anhydro-3-ethyl-11,13-neopentylene-3'-(3-sulfopropyl-)oxathiatricarbocyanine hydroxide, sodium salt
SS-21
Anhydro-5-chloro-9-ethyl-5'-phenyl-3'-(3-sulfobutyl)-3-(3-sulfopropyl)oxacarbocyanine hydroxide, triethylammonium salt
SS-22
Anhydro-5,5'-diphenyl-3,3'-di-(3-sulfobutyl)-9-ethyloxacarbocyanine hydroxide, sodium salt
SS-23
Anhydro-5,5'-dichloro-3,3'-di-(3-sulfopropyl)-9-ethylthiacarbocyanine hydroxide, triethylammonium salt
SS-24
Anhydro-5,5'-dimethyl-3,3'-di-(3-sulfopropyl)-9-ethylthiacarbocyanine hydroxide, sodium salt
SS-25
Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt
SS-26
Anhydro-11-ethyl-1,1'-di-(3-sulfopropyl)naphth[1,2-d]oxazolocarbocyanine hydroxide, sodium salt
SS-27
Anhydro-3,9-diethyl-3'-methylsulfonylcarbamoylmethyl-5-phenyloxathiacarbocyanine p-toluenesulfonate
SS-28
Anhydro-6,6'-dichloro-1,1'-diethyl-3,3'-di-(3-sulfopropyl)-5,5'-bis(trifluoromethyl)benzimidazolocarbocyanine hydroxide, sodium salt
SS-29
Anhydro-5'-chloro-5-phenyl-3,3'-di-(3-sulfopropyl)oxathiacyanine hydroxide, sodium salt
SS-30
Anhydro-5,5'-dichloro-3,3'-di-(3-sulfopropyl)thiacyanine hydroxide, sodium salt
SS-31
3-Ethyl-5-[1,4-dihydro-1-(4-sulfobutyl)pyridin-4-ylidene]rhodanine, triethylammonium salt
SS-32
1-Carboxyethyl-5-[2-(3-ethylbenzoxazolin-2-ylidene)ethylidene]-3-phenylthiohydantoin
SS-33
4-[2-((1,4-Dihydro-1-dodecylpyridin-ylidene)ethylidene]-3-phenyl-2-isoxazolin-5-one
SS-34
5-(3-Ethylbenzoxazolin-2-ylidene)-3-phenylrhodanine
SS-35
1,3-Diethyl-5-{[1-ethyl-3-(3-sulfopropyl)benzimidazolin-2-ylidene]ethylidene}-2-thiobarbituric
SS-36
5-[2-(3-Ethylbenzoxazolin-2-ylidene)ethylidene]-1-methyl-2-dimethylamino-4-oxo-3-phenylim-:idazolinium p-toluenesulfonate
SS-37
5-[2-(5-Carboxy-3-methylbenzoxazolin-2-ylidene)ethylidene]-3-cyano-4-phenyl-1-(4-methylsulfonamido-3-pyrrolin-5-one
SS-38
2-[4-(Hexylsulfonamido)benzoylcyanomethine]-2-(2-{3-(2-methoxyethyl)-5-[(2-methoxyethyl)sulfonamido]-benzoxazolin-2-ylidene}ethylidene]acetonitrile
SS-39
3-Methyl-4-[2-(3-ethyl-5,6-dimethylbenzotellurazolin-2-ylidene)ethylidene]-1-phenyl-2-pyrazolin-5-one
SS-40
3-Heptyl-1-phenyl-5-{4-[3-(3-sulfobutyl)-naphtho[1,2-thiazolin]-2-butenylidene}-2-thiohydantoin
SS-41
1,4-Phenylene-bis(2-aminovinyl-3-methyl-2-thiazolinium] dichloride
SS-42
Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium
SS-43
3-Carboxymethyl-5-{3-carboxymethyl-4-oxo-5-methyl-1,3,4-thiadiazolin-2-ylidene)ethylidene]thiazolin-2-ylidene}rhodanine, dipotassium salt
SS-44
1,3-Diethyl-5-[1-methyl-2-(3,5-dimethylbenzotellurazolin-2-ylidene)ethylidene]-2-thiobarbituric acid
SS-45
3-Methyl-4-[2-(3-ethyl-5,6-dimethylbenzotellurazolin-2-ylidene)-1-methylethylidene]-1-phenyl-2-pyrazolin-5-one
SS-46
1,3-Diethyl-5-[1-ethyl-2-(3-ethyl-5,6-dimethoxybenzotellurazolin-2-ylidene)ethylidene]-2-thiobarbituric acid
SS-47
3-Ethyl-5-{[(ethylbenzothiazolin-2-ylidene)-methyl][(1,5-dimethylnaphtho[1,2-d]selenazolin-2-ylidene)methyl]methylene}rhodanine
SS-48
5-{Bis[(3-ethyl-5,6-dimethylbenzothiazolin-2-ylidene)-methyl]methylene}-1,3-diethyl-barbituric acid
SS-49
3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-di-(3-sulfopropyl)thiacyanine hydroxide, triethylammonium salt

SS-51

Anhydro-5-chloro-5'-phenyl-3,3'-di-(3-sulfopropyl)-thiacyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions of this invention can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure, Vol.* 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure,* Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure,* Item 11684, cited above; purines as illustrated by Sheppard et al U.S. Pat. No. 2,319,090, Birr et al U.S. Pat. No. 2,152,460, *Research Disclosure,* Item 13452, cited above, and Dostes et al French Patent 2,296,204, polymers of 1,3-dihydroxy (and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions, Focal Press, London,* 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by von Konig U.S.

Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et.al U.S. Pat. Nos. 2,759,821 and '822; azole and mercaptotetrazole hydrophilic colloid dispersions of the type disclosed by Research Disclosure, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure,* Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure,* Vol. 136, August, 1975, Item 13651.

Apart from the features that have been specifically discussed the tabular grain emulsion preparation procedures, the tabular grains that they produce, and their further use in photography can take any convenient conventional form. Substitution for conventional emulsions of the same or similar silver halide composition is generally contemplated, with substitution for silver halide emulsions of differing halide composition, particularly tabular grain emulsions, being also feasible in many types of photographic applications. The low levels of native blue and UV sensitivity of the high chloride {100} tabular grain emulsions of the invention allows the emulsions to be employed in any desired layer order arrangement in multicolor photographic elements, including any of the layer order arrangements disclosed by Kofron et al U.S. Pat. No. 4,439,520, the disclosure of which is here incorporated by reference, both for layer order arrangements and for other conventional features of photographic elements containing tabular grain emulsions. Conventional features are further illustrated by the following incorporated by reference disclosures:

ICBR-1: *Research Disclosure,* Vol. 308, December 1989, Item 308,119;

ICBR-2: *Research Disclosure,* Vol. 225, January 1983, Item 22,534;

ICBR-3: Wey et al U.S. Pat. No. 4,414,306, issued Nov. 8, 1983;

ICBR-4: Solberg et al U.S. Pat. No. 4,433,048, issued Feb. 21, 1984;

ICBR-5: Wilgus et al U.S. Pat. No. 4,434,226, issued Feb. 28, 1984;

ICBR-6: Maskasky U.S. Pat. No. 4,435,501, issued Mar. 6, 1984;

ICBR-7: Maskasky U.S. Pat. No. 4,643,966, issued Feb. 17, 1987;

ICBR-8: Daubendiek et al U.S. Pat. No. 4,672,027, issued Jan. 9, 1987;

ICBR-9: Daubendiek et al U.S. Pat. No. 4,693,964, issued Sep. 15, 1987;

ICBR-10: Maskasky U.S. Pat. No. 4,713,320, issued Dec. 15, 1987;

ICBR-11: Saitou et al U.S. Pat. No. 4,797,354, issued Jan. 10, 1989;

ICBR-12: Ikeda et al U.S. Pat. No. 4,806,461, issued Feb. 21, 1989;

ICBR-13: Makino et al U.S. Pat. No. 4,853,322, issued Aug. 1, 1989; and

ICBR-14: Daubendiek et al U.S. Pat. No. 4,914,014, issued Apr. 3, 1990.

Photographic elements containing high chloride {100} tabular grain emulsions according to this invention can be imagewise-exposed with various forms of energy which encompass the ultraviolet and visible (e.g., actinic) and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. Exposures can be monochromatic, orthochromatic or panchromatic. Imagewise exposures at ambient, elevated or reduced temperatures and/or pressures, including high- or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., Macmillan, 1977, Chapters 4, 6, 17, 18 and 23.

EXAMPLES

The invention can be better appreciated by reference to the following examples. The term "low methionine gelatin" is employed, except as otherwise indicated, to designate gelatin that has been treated with an oxidizing agent to reduce its methionine content to less than 30 micromoles per gram.

EMULSION PRECIPITATIONS

Emulsion A (Comparison)

This emulsion demonstrates a high chloride {100} tabular grain emulsion prepared using iodide only during nucleation. The final halide composition was 99.964 mole percent chloride and 0.036 mole percent iodide, based on silver.

A 1.5 L solution containing 3.52% by weight of low methionine gelatin, 0.0056M sodium chloride and 0.3 mL of polyethylene glycol antifoamant was provided in a stirred reaction vessel at 40° C. While the solution was vigorously stirred, 45 mL of a 0.01M potassium iodide solution were added. This was followed by the addition of 50 mL of 1.25M silver nitrate and 50 mL of a 1.25M sodium chloride solution added simultaneously at a rate of 100 mL/min each. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously each at 10 mL/min for 30 minutes, followed by a linear acceleration from 10 mL/min to 15 mL/min over 125 minutes, then constant flow rate growth for 30 minutes at 15 mL/min while maintaining the pCl at 2.35. The pCl was then adjusted to 1.65 with sodium chloride. Fifty grams of phthalated gelatin were added, and the emulsion was washed and concentrated using the procedures of Yutzy et al U.S. Pat. No. 2,614,918. The pCl after washing was 2.0. Twenty-one grams of low methionine gel were added to the emulsion. The pCl of the emulsion was adjusted to 1.65 with sodium chloride, and the pH of the emulsion was adjusted to 5.7.

The resulting high chloride (100} tabular grain emulsion contained 0.036 mole percent iodide, with the balance of the halide being chloride. The emulsion exhibited a mean ECD of 1.6 μm and a mean grain thickness of 0.125 μm with tabular grains accounting for approximately 90 percent of the total grain projected area.

Emulsion B (Comparison)

This is a demonstration of a high chloride {100} tabular grain emulsion in which additional iodide was added uniformly during the addition of the final 83.4% of the silver added during precipitation. The final overall halide composition of the emulsion was 99.43 mole percent chloride and 0.57 mole percent iodide, based on silver.

This emulsion was precipitated identically to Emulsion A, except that the 0.625M sodium chloride solution was replaced with a 0.621M sodium chloride and 0.004M potassium iodide solution and the pCl during the ramped flow growth segment was controlled at 1.8.

The resulting high chloride {100} tabular grain emulsion had a mean ECD of 1.6 μm and an average grain thickness of 0.13 μm. The tabular grain projected area was approximately 80 percent.

Emulsion C (Comparison)

This demonstrates a high chloride cubic grain emulsion prepared by adding iodide in a concentrated band after 94% of the silver had been precipitated.

A 5.0 L solution containing 1.6% by weight of low methionine gelatin, 0.0051M sodium chloride and 1.0 mL of ethylene oxide/propylene oxide block copolymer antifoamant were provided in a stirred reaction vessel at 65° C. While the solution was vigorously stirred, a 4.0M silver nitrate solution containing 0.01 mg of mercuric chloride per mole of silver nitrate and a 4.0M sodium chloride solution were simultaneously added at a rate of 18 mL/min each for 1 minute with the pCl controlled at 1.6. Over the next 20 minutes, the flow rates of the silver nitrate and salt solution were increased from 18 to 80 mL/min, then the flow rates were held constant at 80 mL/min for 60 minutes with the pCl controlled at 1.6. 248 mL of 0.5M potassium iodide were then added rapidly, and the emulsion was held for 20 minutes. Following the hold, the 4.0M silver nitrate and the 4.0M sodium chloride solutions were added at 80 mL/min for 5 minutes. The emulsion was then washed and concentrated by ultrafiltration. 560 g of low methionine gelatin were added, and the pCl was adjusted to 1.6 with a sodium chloride solution.

The resulting cubic grain emulsion had a mean cubic edge length of 0.7 μm.

Emulsion D (Invention)

This example demonstrates the preparation of a high chloride {100} tabular grain emulsion according to the invention in which a higher iodide band was inserted in the grain structure during growth by a single rapid addition of a soluble iodide salt. pCl cycling before the iodide band addition was undertaken. In this example a higher iodide band was introduced after 94% of the emulsion silver was precipitated. An additional 6% of the silver was introduced after the iodide band addition. The final overall emulsion composition was 99.44 mole percent chloride and 0.56 mole percent iodide, based on silver.

The precipitation of this emulsion was identical to comparative Emulsion A, except that following the 125 minute accelerated growth stage, the pCl was adjusted to 1.6 by running the 1.25M sodium chloride solution at 20 mL/min for 8 min. This was followed by a 10 min. hold then the addition of the 1.25M silver nitrate solution at 5 mL/min for 30 minutes. This was followed by the addition of 16 mL of 0.5M potassium iodide and a 20 minute hold. Following the hold, the 0.625M silver nitrate and the 0.625M sodium chloride solution were added simultaneously at 15 mL/min for 10 minutes. The pCl was then adjusted to 1.6, and the emulsion was washed identically to Emulsion A.

The mean ECD of the emulsion was 1.8 μm and the average grain thickness was 0.13 μm. The tabular grain projected area was approximately 85 percent of the total grain projected area.

Emulsion E (Invention)

This example demonstrates a high chloride {100} tabular grain emulsion according to the invention prepared identically to Emulsion D, except that 32 mL of the 0.5M KI solution was added to double the iodide in the band, so that the final overall emulsion halide composition was 98.78 mole percent chloride and 1.22 mole percent iodide, based on silver.

The mean ECD of the emulsion was 1.8 μm and the average grain thickness was 0.13 μm. The tabular grain projected area was approximately 80 percent of the total grain projected area.

Emulsion F (Invention)

This example demonstrates a high chloride {100} tabular grain emulsion according to the invention prepared identically to Emulsion D, except that 16 mL of a 0.25M potassium iodide solution were added in place of the 16 mL of 0.5M potassium iodide solution, thus halving the iodide concentration in the higher iodide band, so that the final overall halide composition was 99.70 mole percent chloride and 0.30 mole percent iodide.

The mean ECD of the emulsion was 1.8 μm and the average grain thickness was 0.13 μm. The tabular grain projected area was approximately 87 percent of the total grain projected area.

Emulsion G (Invention)

This example demonstrates a high chloride {100} tabular grain emulsion according to the invention prepared identically to Emulsion A, except that the accelerated growth stage was stopped after 84.7 min. when the flow rate was 13.4 mL/min. The pCl was the adjusted to 1.6 by the addition of the 1.25 M sodium chloride solution at 20 mL/min for 7.5 min. This was followed by a 10 min. hold, then the addition of the 1.25M silver nitrate solution at 5 mL/min for 30 min. 16 mL of 0.5M potassium iodide was then rapidly added followed by a 20 min. hold. The accelerated flow growth was then continued with the flow rates of the 0.625M silver nitrate and the 0.625M sodium chloride solutions increasing from 13.4 to 15.0 mL/min over 40.3 min. This was followed by 10 minutes at a constant flow rate of 15 mL/min. The pCl was then adjusted to 1.6, and the emulsion was washed and prepared for storage and finishing as described for Emulsion A.

The mean ECD of the emulsion was 1.7 μm and the average grain thickness was 0.13 μm. The tabular grain projected area was approximately 90 percent of the total grain projected area.

Emulsion H (Invention)

This example demonstrates a high chloride {100} tabular grain emulsion according to the invention prepared identically to Emulsion D, except the addition of the 16 mL of 0.5M potassium iodide was postponed until after the final 10 minute constant flow growth segment.

The mean ECD of the emulsion was 1.8 μm and the average grain thickness was 0.13 μm. The tabular grain projected area was approximately 85 percent of the total grain projected area.

Emulsion I (Invention)

This example demonstrates the preparation of a high chloride {100} tabular emulsion according to the invention prepared by employing a rapid iodide addition after about 50% of the emulsion silver was precipitated. The emulsion preparation was identical to that of Emulsion G, except the accelerated growth stage was stopped after 46.0 min. instead of 84.7 min. The accelerated flow segment was continued after the iodide addition of 79 min. with the flow rates of the 0.625M silver nitrate and the 0.625M sodium chloride solutions increasing from 11.8 mL/min to 15 mL/min. The ionic adjustments and washing procedures were unchanged.

The mean ECD of the emulsion was 1.8 μm and the average grain thickness was 0.13 μm. The tabular grain projected area was approximately 80 percent of the total grain projected area.

Emulsion J (Invention)

This example demonstrates a high chloride {100} tabular grain emulsion prepared by the rapid addition of bromide ion to the emulsion surface to produce an emulsion with a composition of 96.46% silver chloride, 3.00 % silver bromide, and 0.54 % silver iodide.

The emulsion preparation was identical to that of Emulsion D, except that after the final 10 minute constant flow growth stage, 30 mL of a 1.5M potassium bromide solution was rapidly added followed by a 20 minute hold. The pCl was then adjusted 1.6 with sodium chloride solution and the emulsion was washed and prepared for storage as described for Emulsion D.

The mean ECD of the emulsion was 1.8 μm and the average grain thickness was 0.13 μm. The tabular grain projected area was approximately 83 percent of the total grain projected area.

Emulsion K (Invention)

This example demonstrates a high chloride {100} tabular grain emulsion prepared by adding a small amount of iodide uniformly during growth and then rapidly adding iodide at the end of the growth stage. The final overall halide composition is 99.42 mole percent chloride and 0.58 mole percent iodide.

The preparation of this emulsion was identical to that of Emulsion A, except that the 0.625M sodium chloride solution used in the accelerated flow and final constant flow growth stages was replaced with a 0.6244M sodium chloride 0.0006M potassium iodide salt solution. Following the final constant flow rate growth segment, 14 mL of a 0.5M potassium iodide solution was rapidly added, and the emulsion was held for 20 minutes. The pCl was then adjusted to 1.6 and the emulsion was washed and prepared for storage like Emulsion A.

The mean ECD of the emulsion was 2.0 μm and the average grain thickness was 0.11 μm. The tabular grain projected area was approximately 80 percent of the total grain projected area.

Emulsion L (Invention)

This example demonstrates a high chloride {100} surface tabular emulsion with iodide added identically as in the preparation of Emulsion D, but with the growth conditions modified to produce a moderate aspect ratio emulsion.

The preparation was identical to Emulsion E, except that the pCl was controlled at 1.6 during the accelerated growth stage. The pCl remained at 1.6 when the 16 mL of 0.5M potassium iodide was added, and the final constant growth stage was also run at a pCl of 1.6. The emulsion was washed and prepared for storage like Emulsion D.

The mean ECD of the emulsion was 1.2 μm and the average grain thickness was 0.25 μm. The tabular grain projected area was approximately 75 percent of the total grain projected area.

Emulsion M (Invention)

This example demonstrates the preparation of a high chloride {100} tabular grain emulsion identically to the preparation of Emulsion G, except the 16 mL 0.5M potassium iodide solution was replaced with a 16 mL 2.0M potassium iodide solution. The resulting final bulk composition was 97.85% silver chloride and 2.15% silver iodide.

The mean ECD of the emulsion was 2.0 μm and the average grain thickness was 0.12 μm. The tabular grain projected area was approximately 80 percent of the total grain projected area.

Emulsion N (Invention)

This example demonstrates an emulsion prepared identically to Emulsion L, except the pCl was adjusted to 1.2 during the final growth stages and the iodide addition. The final overall halide composition was 99.44 mole percent chloride and 0.56 mole percent iodide, based on silver.

The mean ECD of the emulsion was 0.89 μm and the average grain thickness was 0.34 μm. The tabular grain projected area was approximately 65 percent of the total grain projected area.

Emulsion O (Invention)

This example demonstrates the preparation of an emulsion using a ripening agent before the iodide addition to improve the incorporation of iodide into the tabular grains. The final overall halide composition was 99.45 mole percent chloride and 0.55 mole percent iodide, based on silver.

This emulsion was made identically to Emulsion D, except that a the 0.625M silver nitrate and the 0.625 sodium chloride solutions used during the ramped growth segment were replaced with a 1.25M silver nitrate solution and a 1.2488M sodium chloride 0.0013M potassium iodide solution. The temperature was increased to 45° C during the first 3 minutes of the ramped growth segment, the time of the ramped growth was reduced to 122 minutes, and the pCl was controlled at 2.0 rather than 2.35. The ramped growth segment was followed by the addition of a 5 mL solution containing 0.11 g of 3,6-dithiaoctane-1,8-diol and a 20 minute hold. This was followed by the addition of 21 mL of 0.5M potassium iodide and another 10 minute hold. Following the 10 minute hold, the double jet addition was continued with the 1.25M silver nitrate and the 1.2488M sodium chloride and 0.0013M potassium iodide solution for 10 minutes at a constant flow rate of 15 mL/min. with the pCl at 2.0.

The mean ECD of the emulsion was 2.1 μm and the average grain thickness was 0.16 μm. The tabular grain projected area was approximately 90 percent of the total grain projected area.

Emulsion P (Invention)

This example demonstrates the preparation of an emulsion where the higher iodide band is formed after only 10 percent of the silver has been precipitated. The final halide composition was 99.55 mole percent chloride and 0.45 mole percent iodide.

A 4.4 L solution containing 3.52% by weight of low methionine gelatin, 0.0056M sodium chloride and 0.9 mL of polyethylene glycol antifoamant was provided in a stirred reaction vessel at 30° C. While the solution was vigorously stirred, 135 mL of a 0.02M potassium iodide solution was added. This was followed by the addition of 127.5 mL of a 1.5M silver nitrate containing 0.07 mg mercuric chloride per mole of silver nitrate and 127.5 mL of a 1.5M sodium chloride solution added simultaneously at a rate of 255 mL/min each. The mixture was then held 9 minutes while the temperature was increased to 45° C. Following the hold, a 0.6M silver nitrate solution containing 0.07 mg mercuric chloride per mole of silver nitrate and a 0.6M sodium chloride solution were added simultaneously each at 30 mL/min for 36.5 minutes with the pCl maintained at 2.3. The silver nitrate and sodium chloride additions were then stopped, and 72 mL of a 0.5M potassium iodide solution were rapidly added followed by a 10 minute hold. After the hold, the 1.5M silver nitrate and the 1.5M sodium chloride solutions were again added simultaneously with the flow rate linearly increasing from 30 mL/min to 120 mL/min over 62.5 minutes, then constant at 30 mL/min for 15 minutes while maintaining the pCl at 2.05. The pCl was then adjusted to 1.65, and the emulsion was washed and concentrated using ultrafiltration. One hundred eighty grams of low methionine gelatin were added to the emulsion. The pCl of the emulsion was adjusted to 1.65 with sodium chloride, and the pH of the emulsion was 5.7.

The resulting high chloride {100} tabular grain emulsion had a mean ECD of the emulsion was 1.9 μm and an average thickness of 0.16 μm. The tabular grain projected area was approximately 80 percent of the total grain projected area.

Emulsion Q (Invention)

This example demonstrates the preparation of an emulsion with two higher iodide bands: the first higher iodide band was introduced after 10 percent of the total silver had been precipitated, and the second after 92 percent of the total silver had been precipitated. The final overall halide composition of the emulsion was 99.55 mole percent chloride and 0.045 mole percent iodide.

This emulsion was made identically to Emulsion P, except that after the flow rates linearly increased to 120 mL/min, the silver nitrate and sodium chloride additions were again stopped and 36 mL of the 0.5M potassium iodide solution were added followed by a 10 minute hold. The 1.5M silver nitrate and the 1.5M sodium chloride solutions were then each added at a constant flow rate of 30 mL/min for 15 minutes while maintaining the pCl at 2.05. The pCl was then adjusted to 1.65 and the emulsion was washed and concentrated using ultrafiltration. One hundred eighty grams of low methionine gelatin were added to the emulsion. The pCl of the emulsion was adjusted to 1.65 with sodium chloride and the pH of the emulsion was 5.7.

The resulting high chloride {100} tabular grain emulsion emulsion exhibited a mean ECD of 1.9 μm and the average grain thickness was 0.16 μm. The tabular grain projected area was approximately 80 percent of the total grain projected area.

Emulsion R (Invention)

This example demonstrates the preparation of an emulsion with a higher iodide band that begins after 0 percent of the silver is precipitated and accounts for 25 percent of the total silver precipitated. The final overall halide composition of the emulsion was 9.59 mole percent chloride and 0.41 mole percent iodide.

A 4.4 L solution containing 3.52% by weight of low methionine gelatin, 0.0056M sodium chloride and 0.9 mL of polyethylene glycol antifoamant was provided in a stirred reaction vessel at 30° C. While the solution was vigorously stirred, 135 mL of a 0.02 potassium iodide solution were added. This was followed by the addition of 127.5 mL of a 1.5M silver nitrate containing 0.07 mg mercuric chloride per mole of silver nitrate and 127.5 mL of a 1.5M sodium chloride solution added simultaneously at a rate of 255 mL/min each. The mixture was then held 9 minutes while the temperature was increased to 45° C. Following the hold, a 0.6M silver nitrate solution containing 0.07 mg mercuric chloride per mole of silver nitrate and a 0.6M sodium chloride solution were added simultaneously each at 30 mL/min for 36.5 minutes with the pCl maintained at 2.3. The pCl was then adjusted to 2.0 with sodium chloride, and a 1.5M silver nitrate solution and 1.4775M sodium chloride and 0.0225M potassium iodide solution were then added simultaneously with the flow rate linearly accelerated from 15 to 45 mL/min over 47.5 minutes with the pCl maintained at 2.0. The mixed salt solution was then replaced by a 1.5M sodium chloride solution, and the double jet addition was continued with the flow rates linearly increasing from 45 to 115 mL/min over 46.3 minutes while maintaining the pCl at 2.0. The pCl was then adjusted to 1.65 and the emulsion was washed and concentrated using ultrafiltration. One hundred eighty grams of low methionine gelatin were added to the emulsion. The pCl of the emulsion was adjusted to 1.65 with sodium chloride and the pH of the emulsion was 5 7.

The resulting high chloride {100} tabular grain emulsion exhibited a mean ECD of 1.4 μm and an average grain thickness of 0.18 μm. The tabular grain projected area was approximately 70 percent of the total grain projected area.

SENSITIZATION OF EMULSIONS

The emulsions were each optimally sensitized by the customary empirical technique of varying the level of sensitizing dye, sulfur and gold sensitizers and the hold time at elevated temperature (often referred to as the digestion time) of test samples.

The general sensitization procedure was as follows: A quantity of emulsion suitable for experimental coating was melted at 40° C. Potassium bromide in the amount of 1200 mg per silver mole was added to emulsion not containing iodide added during grain growth. Green sensitizing dye SS-21 was then added followed by a 20 minute hold. This was followed by the addition of sodium thiosulfate pentahydrate then potassium tetrachloroaurate. The temperature of the well stirred mixture was then raised to 60° C. over 12 minutes and held at 60° for a specified time. The emulsion was then cooled to 40° C. as quickly as possible, and 70 mg/mole of 1-(3-acetamidophenyl)-5-mercaptotetrazole was then added and the emulsion was chill set.

PHOTOGRAPHIC COMPARISONS

Each sensitized emulsion was coated on an antihalation layer containing film support at an emulsion coating density 0.85 g/m$^2$ of silver with 1.08 g/m$^2$ of cyan dye forming coupler C and 2.7 g/m$^2$ of gelatin. This layer was overcoated with 1.6 g/m$^2$ of gelatin and the entire coating was hardened with bis(vinylsulfonylmethyl)ether at 1.75% by weight of the total coated gelatin.

Coupler C

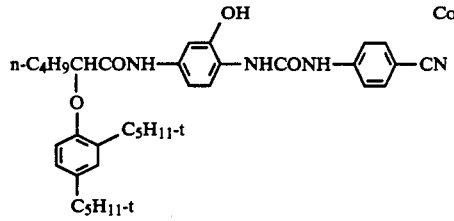

Coatings were exposed through a step wedge for 0.02 second with a 3000° K. tungsten source filtered with a Daylight V and a Kodak Wratten TM 9 filter. The coatings were processed in the Kodak Flexicolor TM C-41 color negative process.

Density and granularity as a function of exposure were obtained using standard densitometry and microdensitometry techniques. The raw granularity measurements were divided by the contrast of the characteristic (density versus log exposure) curve at the density where the granularity was measured. This eliminated differences in observed granularity caused by changes in developability and dye formation, thereby allowing the granularities produced by different emulsion samples to be fairly compared.

Speed is reported as relative log speed. That is, speed is 100 times the log of the exposure required to provide a density of 0.15 above the minimum density. In relative log speed units a speed difference of 30, for example, is a difference of 0.30 log E, where E is exposure in luxseconds.

TABLE I

| Emulsion | Observed Granularity | Observed Relative Log Speed | Speed Normalized for Equal Granularity |
|---|---|---|---|
| A (comp.) | 0.023 | 100 | 100 |
| B (comp.) | 0.024 | 115 | 110 |
| C (comp.) | 0.027 | 74 | 60 |
| D (inven.) | 0.023 | 127 | 127 |
| E (inven.) | 0.022 | 110 | 114 |
| F (inven.) | 0.024 | 122 | 117 |
| G (inven.) | 0.020 | 117 | 129 |
| H (inven.) | 0.021 | 121 | 129 |
| J (inven.) | 0.021 | 113 | 121 |
| L (inven.) | 0.024 | 117 | 113 |
| O (inven.) | 0.036 | 157 | 118 |

Speed normalized for equal granularity is based on a comparison with the speed and granularity of comparison Emulsion A. It is generally accepted that each stop (30 relative log units) increase in speed should increase granularity by 41%. The speed normalized for equal granularity uses this relationship to report the speed that would be expected when granularity is adjusted to the 0.023 value of Emulsion A. From the speed normalized for equal granularity it is apparent that the emulsions of the invention in every instance exhibit higher speeds than and speed-granularity relationships superior to those of the comparison emulsions.

RADIO FREQUENCY PHOTOCONDUCTIVITY

In an effort to determine the mechanism by which iodide banding of the emulsions improves the speed-granularity relations of the emulsions additional coatings of the emulsions were prepared. The coating densities were 1.0 g/m$^2$ of silver and 1.2 g/m$^2$ of gelatin coated on an antihalation film support. The coatings were hardened with bis(vinylsulfonylmethyl)ether at 1.75% of the total gelatin weight. The test apparatus and measurement procedures were similar to those described in *The Theory of the Photographic Process* 4th ed. edited by T. H. James, page 119. A more detailed description is provided by J. E. Keevert, "28th Ann. Conf. and Seminar on Quality Control", Denver, 1975, Society of Photographic Science and Engineering, Washington D.C. pp. 186, 187. Table II shows the maximum radio frequency photoconductivity signal generated by simple black and white coatings of the unsensitized emulsions.

TABLE II

| Emulsion | PNI | RFPC SIGNAL |
|---|---|---|
| A (comparison) | none | 148 |
| B (comparison) | uniform | 149 |
| D (invention) | banded | 15 |
| E (invention) | banded | 18 |
| G (invention) | banded | 28 |
| I (invention) | banded | 18 |
| J (invention) | banded | 8 |
| K (invention) | banded | 22 |
| M (invention) | banded | 28 |

PNI = post nucleation iodide addition

From Table II it is apparent that the iodide banded high chloride {100} tabular grain emulsions of the invention show a much smaller signal than the comparative emulsions that did not contain iodide or that had iodide uniformly distributed. This decrease in signal is believed to be an indication that the photoelectrons are being more rapidly and effectively utilized to form latent image. This would support the photographic observation of improved speed-granularity.

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions and containing up to 30 percent of the silver in the tabular grain.

2. A radiation sensitive emulsion according to claim 1 wherein the surrounding band forms an exterior tabular grain portion.

3. A radiation sensitive emulsion according to claim 1 wherein the core accounts for at least 5 percent of the total grain silver and the band contains sufficient iodide to increase the average iodide concentration of the grain to a level that exceeds that of the core by at least 0.1 mole percent.

4. A radiation sensitive emulsion according to claim 3 wherein the core accounts for at least 25 percent of the total grain silver.

5. A radiation sensitive emulsion according to claim 3 wherein the band contains sufficient iodide to increase the average iodide concentration of the grain to a level that exceeds that of the core by at least 0.2 mole percent.

6. A radiation sensitive emulsion according to claim 1 wherein the tabular grains account for at least 70 percent of total grain projected area.

7. A radiation sensitive emulsion according to claim 6 wherein the tabular grains account for at least 90 percent of total grain projected area.

8. A radiation sensitive emulsion containing a silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions and (4) each band is surrounded by a shell of lower iodide ion content.

9. A radiation sensitive emulsion containing a silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions;

(4) the core accounts for at least 50 percent of the total grain silver; and (5) the band contains sufficient iodide to increase the average iodide concentration of the grain to a level that exceeds that of the core by at least 0.1 mole percent.

10. A radiation sensitive emulsion containing a silver halide grain population comprised of at least 50 mole percent chloride, based on silver, wherein at least 50 percent of the grain population projected area is accounted for by tabular grains (1) bounded by {100} major faces having adjacent edge ratios of less than 10 and (2) each having an aspect ratio of at least 2; wherein (3) each of the tabular grains is comprised of a core and a surrounding band containing a higher level of iodide ions;

(4) the band accounts for up to 5 percent of silver; and (5) the band contains sufficient iodide to increase the average iodide concentration of the grain to a level that exceeds that of the core by at least 0.1 mole percent.

11. A radiation sensitive emulsion according to claim 10 wherein the band accounts for up to 2 percent of total silver.

* * * * *